US005875940A

United States Patent [19]

Mayfield

[11] Patent Number: 5,875,940

[45] Date of Patent: Mar. 2, 1999

[54] CONTAINER WITH INTEGRAL STRAW GUIDE

[76] Inventor: Todd A Mayfield, 4745 Winding Rose Rd., Suwanee, Ga. 30174

[21] Appl. No.: 872,220

[22] Filed: Jun. 10, 1997

[51] Int. Cl.[6] ..... B67D 5/40

[52] U.S. Cl. ..... 222/382

[58] Field of Search ..... 222/484.1, 383.1, 222/211, 382, 324; 239/333

[56] References Cited

U.S. PATENT DOCUMENTS

| | | | |
|---|---|---|---|
| 4,865,232 | 9/1989 | Cassady, Jr. et al. | 222/382 |
| 5,279,450 | 1/1994 | Witt, Jr. | 222/324 |
| 5,464,129 | 11/1995 | Ho | 222/382 |
| 5,638,994 | 6/1997 | Libit et al. | 222/382 |

*Primary Examiner*—Philippe Derakshani

[57] ABSTRACT

A trigger spray container that prevents dry firing and solves the problem of interupted spray as the containers contents are dispensed and reduced to a level that allows the end of straw tip of trigger spray apparatus to become disengaged with liquid as the container is tilted towards the users target. As the user inverts or rotates the container from a vertical position, downwardly, towards a horizontal plain and aims the spray tip output nozzel towards the intended target, the liquid level adjusts within the container. Therefore, it becomes advantageous for end of straw tip to be positioned at the lowest point on container base, side of container base nearest target. This is achieved by forming an integral straw guide molded into the container body that provides a passage way or tube for the straw to be guided through, thereby directing the straw tip to this position. The straw length of the trigger spray apparatus is of sufficient length such that it travels through integral straw guide and engages with intended base corner as trigger spray apparatus becomes securably attached to the mouth opening of container. The liquid contents of the container can now be fully consumed, without pumping air during operation, as the consumer uses the product in its entirety.

4 Claims, 3 Drawing Sheets

CONTAINER WITH INTEGRAL STRAW GUIDE

CROSS REFERENCES TO RELATED APPLICATIONS

BACKGROUND

1. Field of Invention

This invention relates to containers, especially containers or bottles suitable for holding and dispensing liquids, generally through an attachable dispensing device that is manually operated, such as a trigger spray apparatus that dispenses a stream or atomized fluid.

2. Description of Prior Art

Containers (generally plastic) that are specifically designed to receive dispensing devices like an attachable trigger spray apparatus, come in various geometrical shapes and capacities. Such containers like Des. 315,671 and Des. 330,515 are designed so a human being can grasp the container and pump a trigger spray mechanism comfortably with one hand. These types of containers are convenient and effective for dispensing various liquids such as; house-hold cleaning products, industrial solutions, automotive products, pet products and agricultural products. However, at least 90% of the time when using these products the container must be rotated downwardly from the vertical position towards a horizontal plane or inverted so that the spray tip output nozzel of dispensing apparatus can be positioned respectively towards the consumer's target. In doing so, liquid contents shift accordingly within the container. As the liquid contents are reduced inside the container the straw of dispensing device becomes disengaged with liquid when the container is in this position. Therefore, the consumer must frequently re-prime the dispensing system by returning the container to the vertical position and repeatedly squeeze the trigger spray device to purge air out of the system, thus creating an inconvenience. This situation occurs usually when there is at least 30% of liquid still left in the container. Other attempts have been made to try and improve this field of art so that 100% of the product can be used. U.S. Pat. Nos. 5,279,450, Container With Two Seperate Chambers and 5,518,150, Multi-Chambered Container Having A Tube Insertion Guide Wall have attempted to solve this problem but unfortunately, still have problems when used in the most popular and desired dispensing positions.

The applications for liquid products in containers of the type require the consumer to rotate subject container from a vertical position, downwardly, to approximately 90 degrees or even past a horizontal plane to directly engage consumers intended target. It therefore becomes advantageous that straw tip of trigger spray dispensing apparatus be positioned internally at the lowest point on container base, side nearest intended target, when container is in desired position.

The problem with U.S. Pat. Nos. 5,279,450 and 5,518,150 are; they both have undesireable seperate chambers that interrupt communication between liquid and dispensing suction tube within the container. As these containers are rotated downwardly towards desired dispensing position, with spray tip output nozzel directed towards target, the liquid leaves smaller chamber where suction tube is and pours back into larger chamber. This permits air back into suction tube thereby requiring dispensing system to be re-primed.

There remains a need for an effective container to dispense liquids in a horizontal or inverted position without having to re-prime the dispensing system. My present invention "Container With Integral Straw Guide" provides a solution to this problem and enables the consumer to use 100% of liquid contents in the most popular and desired dispensing positions, without having to re-prime the trigger spray apparatus.

OBJECTS AND ADVANTAGES

Accordingly, several objects and advantages of my invention are to prevent dry firing from occuring once the trigger spray apparatus has been primed. The new container solves the problem of interupted spray as the contents are reduced to a level that permits the end of straw tip of trigger spray apparatus to become disengaged with liquid as container is inverted or rotated from vertical position, downwardly, towards the users target. In this tilted position, the liquid level adjusts within the container respective to the angular rotatation induced by consumer for spray to reach the intended target. Thus it becomes advantageous for straw tip to be postioned at the lowest point of container base, at juncture of sidewall, side closest to target, so that the tip remains submerssed, allowing the contents to be consumed in its entirity without pumping air. This is achieved by molding an integral, hollow passage way into the container body thereby acting as a guide. During assembly of the trigger spray device to the container, the straw tip enters the sealable mouth opening of bottle and slides down into funnel lead entry opening and through integral straw guide (hollow passage way) as it is directed towards the lowest point of container base, side nearest spray nozzle or target.

Still further objects and advantages will become apparent from a consideration of the ensuing description and accompanying drawings.

REFERENCE NUMERALS

Figure 1:
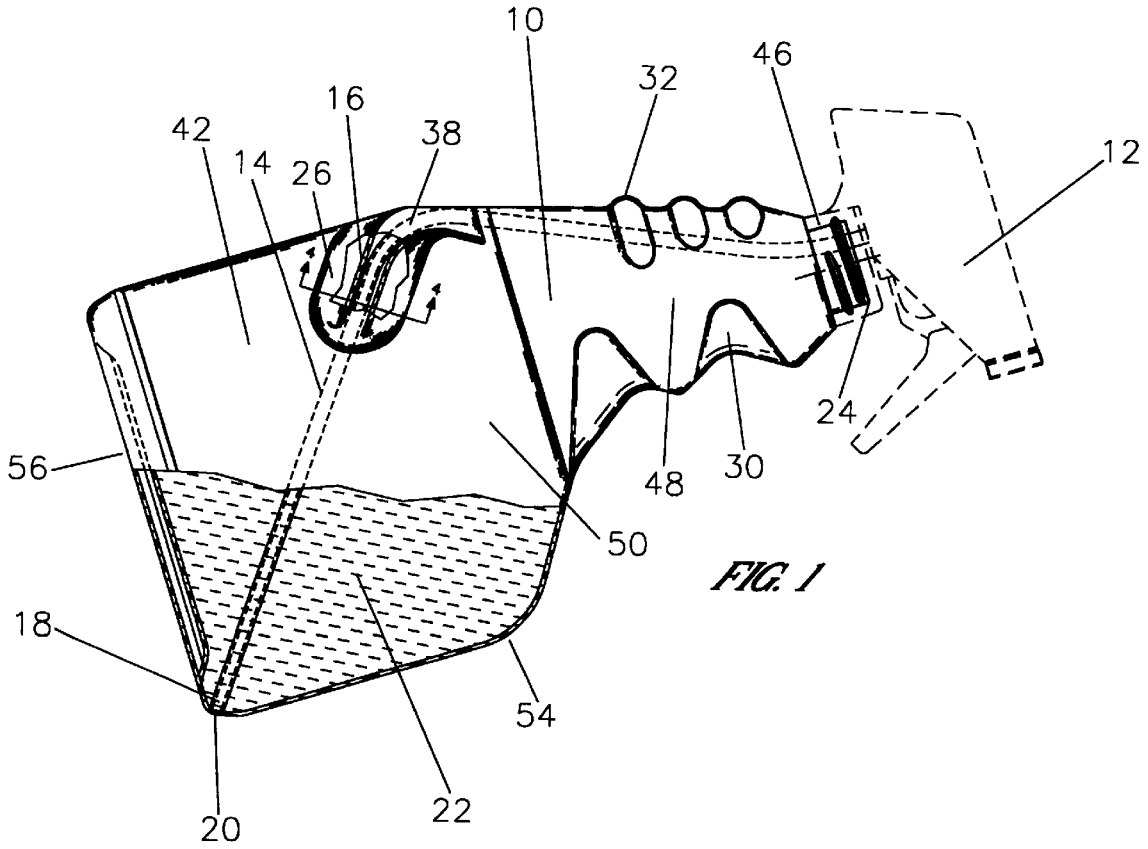
FIG. 1 is an assembly view of my invention shown in an inverted position.

10 container
12 trigger spray apparatus
14 straw
16 integral straw guide
18 straw tip
20 base corner
22 liquid
24 sealable aperture
26 relief angle indentations
28 mold parting line
30 finger gripping surfaces
32 non-slip gripping ribs
34 assembly
36 funnel mouth opening
38 gradual radius
40 manual dispensing apparatus
42 lower containment body
44 fluid dispenser
46 neck
48 upper top end
50 front wall

52 rear wall
54 side wall
56 base

SUMMARY

A trigger spray container produced from a moldable material suitable for holding and or dispensing liquids therefrom, comprising: an integral straw guide formed into a portion of container body that guides straw of a trigger spray apparatus or other manual dispensing apparatus to intended base corner, as trigger spray apparatus becomes securably attached to the mouth opening of container, at least one sealable opening, a gripping area respectably sized for holding by a human being located beneath at least one sealable opening, whereby these features allow the liquid contents of container to be fully consumed, without pumping air during operation, even while inverted or rotated from a vertical position, downwardly, towards a horizontal plain so that spray tip output nozzel is directed towards target, allowing the consumer to use 100% of the liquid product contained.

PREFERRED EMBODIMENT—DESCRIPTION

As shown in FIG. 1, container 10 is in an inverted position with trigger spray apparatus 12 aimed at target (not shown) and illustrates how straw 14 is inserted through integral straw guide 16, forming gradual radius 38, as straw 14 is directed so that straw tip 18 of straw 14 is contacting base corner 20 of base 56, allowing straw tip 18 to remain submerssed in liquid 22 at all times during operation, while trigger spray apparatus 12 is securably attached to neck 46 with sealable aperture 24. While other integral straw guide methods can be used, the method shown is molded inwardly and is comprised of a portion of front wall 50, rear wall 52, and side wall 54 that futher illustrates relief angle indentations 26 that are generally created on both sides of container 10 into the lower containment body 42 when forming integral straw guide 16. This provides draft relief so that after the mold sections come together and pinch the container material along mold parting line 28 (shown in FIG. 3), container 10 will be ejected smoothly from molds without damaging the intergrity of container material.

In accordance with the invention, container 10 is conveniently designed for human hands (not shown) having upper top end 48 so that container 10 may easily be grasped or held comfortably with one hand. Although it is not necessary, container 10 (shown in FIG. 1), could provide finger gripping surfaces 30 and non-slip gripping ribs 32 for improved comfort during operation.

Figure 2:
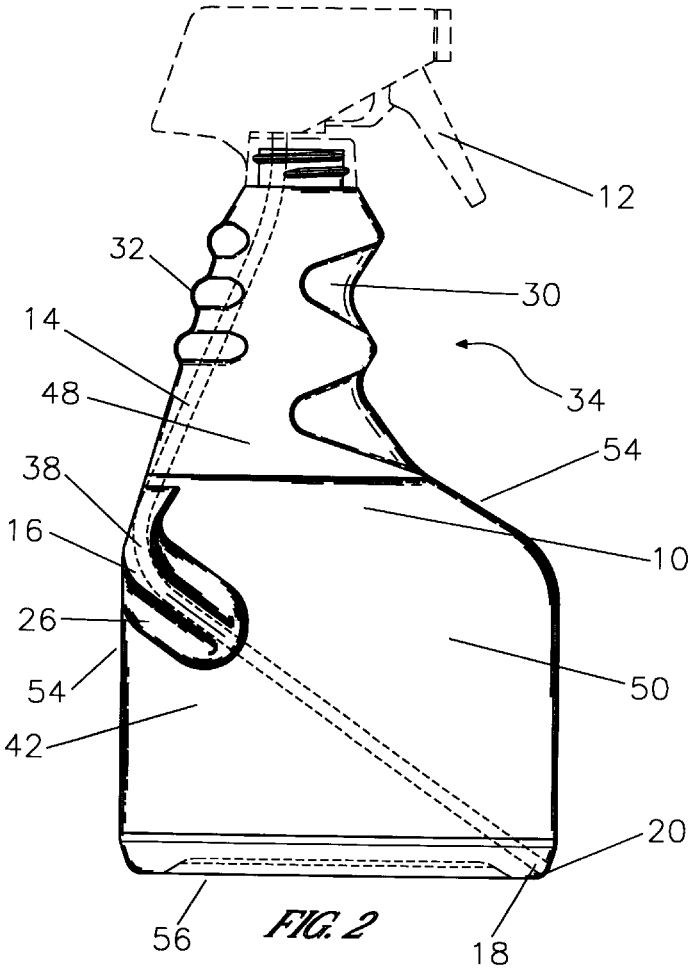
FIG. 2 is a front side view

FIG. 2—front side view, shows assembly 34, comprised of trigger spray apparatus 12 and straw 14, securably attached to neck 46 with sealable aperture 24, of container 10.

Figure 3:
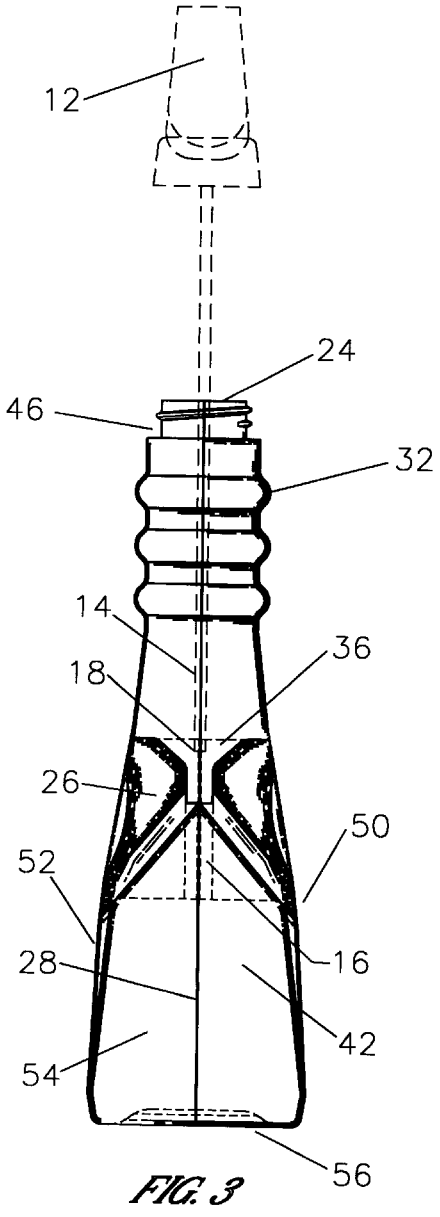
FIG. 3 is a left end view
Figure 5:
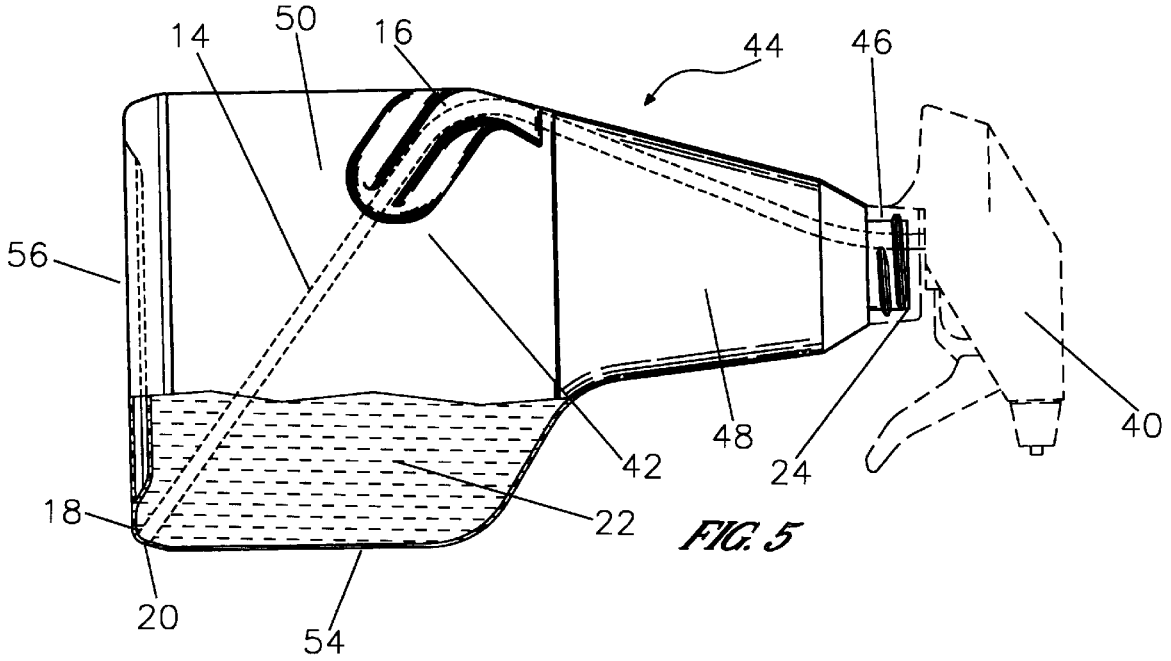
FIG. 5 shows a front side view of my fluid dispenser rotated from a vertical position to a horizontal plane.
Figure 4:
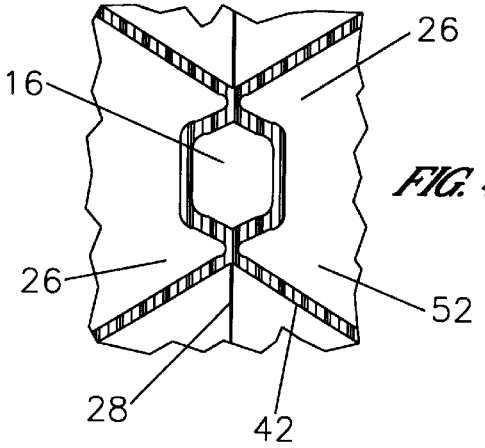
FIG. 4 is a view in detail of the portion indicated by section lines 4—4 in FIG. 1

The end view in FIG. 3 shows funnel mouth opening 36 of integral straw guide 16 mold parting line 28 and demonstrates how straw 14 is received and guided into position as (FIG. 1) becomes securably attached to neck 46 with sealable aperture 24 of container 10. FIG. 4—is a view in detail indicated by section lines 4—4 in FIG. 1, and is rotated 90 degrees towards mold line 28 to show a cross-sectional area of integral straw guide 16 and a profile of its tubular passageway that straw 14 is inserted through. FIG. 5—front side view, shows fluid dispenser 44 in a horizontal plane, with securably attached to neck 46 with sealable aperture 24, whereby straw 14 is inserted through integral straw guide 16, allowing straw tip 18 of straw 14 to be guided and directed to base corner 20 of lower containment body 42.

PREFERRED EMBODIMENT—OPERATION

Operation and use of the invention is simple and straightforward. As container 10 or fluid dispenser 44 are being produced with moldable material (generally high density or low density polyethlene or other plastic material) through a blow molding process, integral straw guide 16 is formed inwardly using a combined portion of front wall 50, rear wall 52, and side wall 54, with relief angle indentations 26, as the mold sections close together and seat. When the mold sections are clamped in the seated position, air is blown into the cavity of the mold and forces the parison or plastic material to the outer confines of the mold. Upon contact of the mold cavity walls, the plastic material cools, and container 10 or fluid dispenser 44 are formed with integral straw guide 16.

As straw 14, of trigger spray apparatus 12 or manual dispensing apparatus 40, is inserted through neck 46 with sealable aperture 24, straw 14 is received by funnel mouth opening 36 of integral straw guide 16. As straw 14 passes through integral straw guide 16 it bends straw 14 forming gradual radius 38 as straw 14 changes directions and moves towards base corner 20, of base 56, in lower containment body 42. Straw 14 of trigger spray apparatus 12 or manual dispensing apparatus 40 is of adequate length such that straw tip 18 makes contact with base corner 20, located opposite side from integral straw guide 16 as trigger spray apparatus 12 or manual dispensing apperatus 40 is seated and attached to neck 46 with sealable aperture 24, of container 10 or fluid dispenser 44.

The upper top end 48 of container 10 and fluid dispenser 40, below neck 46 with sealable aperture 24, are designed so that they can be easily and comfortably grasped by human hands. Non-slip gripping ribs 32 and finger gripping surfaces 30 improve hand fatigue during extended operation of trigger spray apparatus 12. However, other embodiments such as fluid dispenser 44, depending upon product applications may omit non-slip gripping ribs 32 and finger gripping surfaces 30 and provide an alternate gripping area respectably sized for holding by a human being, yet not depart from the of the invention.

CONCLUSIONS, RAMIFICATIONS, AND SCOPE

Accordingly, it can be seen that the invention offers distinct advantages over existing trigger spray containers. The new container solves the problem of interupted spray as containers contents are dispensed to a level that allows the straw tip to become disengaged with liquid as the container is tilted towards the users target. The integral straw guide directs the straw of the trigger spray assembly to base corner of container body (side opposing straw guide) thereby holding straw in an optimum position so that entire contents can be consumed without pumping air, even when the container is in an inverted position. The integral straw guide can be molded into the container body through conventional blow molding processes, yet is economical to fabricate, reliable and easily recieves the intended straw of trigger spray apparatus.

Although the description above contains many specificities, these should not be construed as limiting the scope of the invention but as merely providing illustrations of some of the presently preferred embodiments of this invention. Various other embodiments and ramifications are possible within it's scope. For example, shapes, sizes and capacities of the container may vary depended upon the product application, therewith positioning and location of the integral straw guide.

Thus the scope of the invention should be determined by the appended claims and their legal equivalents, rather than by the examples given.

What is claimed is:

1. A container produced from a moldable material suitable for holding and or dispensing liquids therefrom, comprising:

a) a front wall, a rear wall and a pair of side walls, all joined together to form a bottom end creating a base, and an upper top end substantially elongated to be held by a human hand, b) said upper top end having a neck with sealable aperture for attaching a dispensing apparatus or closure cap, c) said upper top end comprising a gripping area located beneath said neck with sealable aperture, d) said front wall, said rear wall and at least one side wall having inwardly projecting wall portions, defining an integral straw guide, whereby said integral straw guide slopes downwardly from said upper top end or said side wall for a distance, towards said base, e) said integral straw guide having the means to direct straw tip of a dispensing apparatus to a comer of said base.

2. A container as claimed in claim 1, wherein said integral straw guide is located below said neck with sealable aperture and is positioned to receive straw of said dispensing apparatus and guide said straw tip to a corner of said base, so that said straw tip remains submersed in liquid even when said container is inverted or rotated towards a horizontal plain.

3. A container as claimed in claim 2, wherein one version of said integral straw guide is formed having a lead entry opening that is funnel shaped, tapered or otherwise respectively shaped and positioned for receiving said straw during said insertion of said dispensing apparatus and whereby base of lead entry opening adjoins tubular passageway, sized for said straw to easily slide through said passageway.

4. A fluid dispenser suitable for containing a liquid, comprising:

a) an elongated containment means having a neck with sealable aperture for filling said elongated containment means and securably attaching a dispensing apparatus, whereby said elongated containment means is respectably sized for holding by a human hand, b) said fluid dispenser having said dispensing apparatus with a straw of sufficient length to reach a base comer at the bottom of said elongated containment means for atomizing or spraying the liquid contained, c) said elongated containment means having inwardly projecting wall portions defining an integral straw guide located beneath said neck with sealable aperture, whereby said integral straw guide slopes downwardly from said upper top end or said side wall, for a distance towards base, and receives said straw of said dispensing apparatus and directs tip of said straw towards said base comer, as said dispensing apparatus becomes securably attached to said neck with sealable aperture, d) said integral straw guide thereby keeping said straw of said dispensing apparatus in said base comer wherein said straw remains submersed in liquid, even when said fluid dispenser is inverted and rotated towards a horizontal position.

* * * * *